US005687761A

United States Patent [19]

Langes

[11] Patent Number: 5,687,761

[45] Date of Patent: Nov. 18, 1997

[54] SEWER BACKUP INDICATOR APPARATUS

[76] Inventor: Peter Langes, 1113 Oakwood Ave., Vallejo, Calif. 94591

[21] Appl. No.: 727,057

[22] Filed: Oct. 8, 1996

[51] Int. Cl.[6] ..... F16K 37/00

[52] U.S. Cl. ..... 137/558; 137/559; 73/319

[58] Field of Search ..... 137/558, 559; 73/319

[56] References Cited

U.S. PATENT DOCUMENTS

| | | | |
|---|---|---|---|
| 356,448 | 1/1887 | Clark | 137/558 |
| 4,543,892 | 10/1985 | Tomilson et al. | 137/558 |
| 4,962,370 | 10/1990 | Borriello | 137/558 |
| 5,113,901 | 5/1992 | Young | 137/558 |

*Primary Examiner*—A. Michael Chambers
*Attorney, Agent, or Firm*—Larry D. Johnson

[57] ABSTRACT

A sewer lateral cleanout apparatus provides visual indication of an impending sewer backup, for installation on the cleanout riser of a sewer lateral, and includes a housing portion adapted for attachment to the cleanout riser; and a vertically movable piston portion slidably engaged within the housing. The piston includes a float member, a wall member, and a cap member, such that when sewage is not backed up into the cleanout riser, the wall is contained within the housing, and when sewage backs up into the cleanout riser, the float urges the piston to move vertically within the housing to reveal the wall, thereby alerting the user of a backup.

5 Claims, 2 Drawing Sheets

SEWER BACKUP INDICATOR APPARATUS

BACKGROUND OF THE INVENTION

1. Field of the Invention

This invention relates generally to plumbing and sewer construction materials, and more specifically to an improved sewer lateral cleanout apparatus providing visual indication of an impending sewer backup.

2. Description of the Prior Art

Most residential buildings drain their interior plumbing through a sewer lateral to a main sewer line, which is typically located near a street. Known sewer drainage piping is subject to stoppage development at some time, and no system, regardless of how well designed, can be considered to be immune from such conditions.

Sanitary system cleanouts were developed to provide access to the drainage piping for dealing with such problems that will, in all likelihood, occur. These problems can occur for a variety of reasons, including any or all of the following: user neglect, damage to the piping system, inadequate clearing of the initial stoppage within the piping system, improper repairs to the piping system, vermin, and other objectional unsanitary conditions within the piping system.

When stoppage develops in drainage piping, the subsequent sewer backup can create numerous problems, including but not limited to the following: costly damage to the piping system, costly damage to the residence due to sewer backup into the house itself including water damage to floorboards, tiles and carpets, and exposure to the known hazards of household toxins and raw sewage by homeowners and/or cleanup personnel from contact with a variety of germs and bacteria that may be contained within the effluent.

SUMMARY OF THE INVENTION

The sewer backup indicator apparatus of this invention provides visual indication of an impending sewer backup, and is installed on the cleanout riser of a typical residential sewer lateral. The apparatus includes a housing portion adapted for attachment to the cleanout riser, and a vertically movable piston portion slidably engaged within the housing. The piston includes a float member, a wall member, and a cap member, such that when sewage is not backed up into the cleanout riser, the wall member is contained within the housing, and when sewage backs up into the cleanout riser, the float urges the piston to move vertically within the housing to extend and reveal the wall member, thereby alerting the user of a sewer backup.

The inventive apparatus is analogous to a sewer cleanout cap, with a housing/piston assembly that replaces the cleanout plug used to seal the cleanout line of a home sewer system. The rising float exposes a brightly colored wall or section of pipe, which provides visual alert to the user. The apparatus thus provides visual warning to the user that the sewer line is backing up before raw sewage overflows into the home, so that the user may take remedial action.

The inventive apparatus screws into an existing pipe fitting in the sewer lateral, like regular cleanouts, and may measure approximately 12" long (high) by 7" in diameter. The apparatus may be mushroom shaped with am approximately two inch thick cap or head, the only part of the unit which is visible under normal conditions. The housing and/or piston components of the apparatus may be vented to allow water to escape when the sewer line backs up, but such venting preferably utilizes a screened vent to trap solid sewage.

The inventive apparatus is thus easy to install, with no special fittings required, and is capable of operation under extreme environmental conditions. The apparatus may be manufactured in any size, such as to fit both three inch and four inch cleanout lines.

The sewer backup indicator apparatus of this invention thus provides a low-cost, easy to install device which enables a visual warning of an impending sewer backup prior to the actual occurrence of such a backup. The inventive apparatus is also capable of containing (or at least releasing) the sewer backup outside of the residence or other building, which minimizes the possibility of raw sewage entering the building. This will reduce or eliminate water damage to the residence and, therefor, also reduce the possibility of direct human contact with the raw sewage products.

A first embodiment of the inventive apparatus utilizes a small float similar to ones found in the flush-tank mechanism of older water closet tank designs. This float attaches to the underside of a piston in the form of a hollow plastic tube and is held in place with a metal bolt which runs inside the plastic tube and attaches to the cap. In an alternate embodiment, the entire float and piston assembly is of single-piece design and construction. This piston attaches directly to the cap using a threaded head.

DETAILED DESCRIPTION OF A PREFERRED EMBODIMENT

Figure 1:
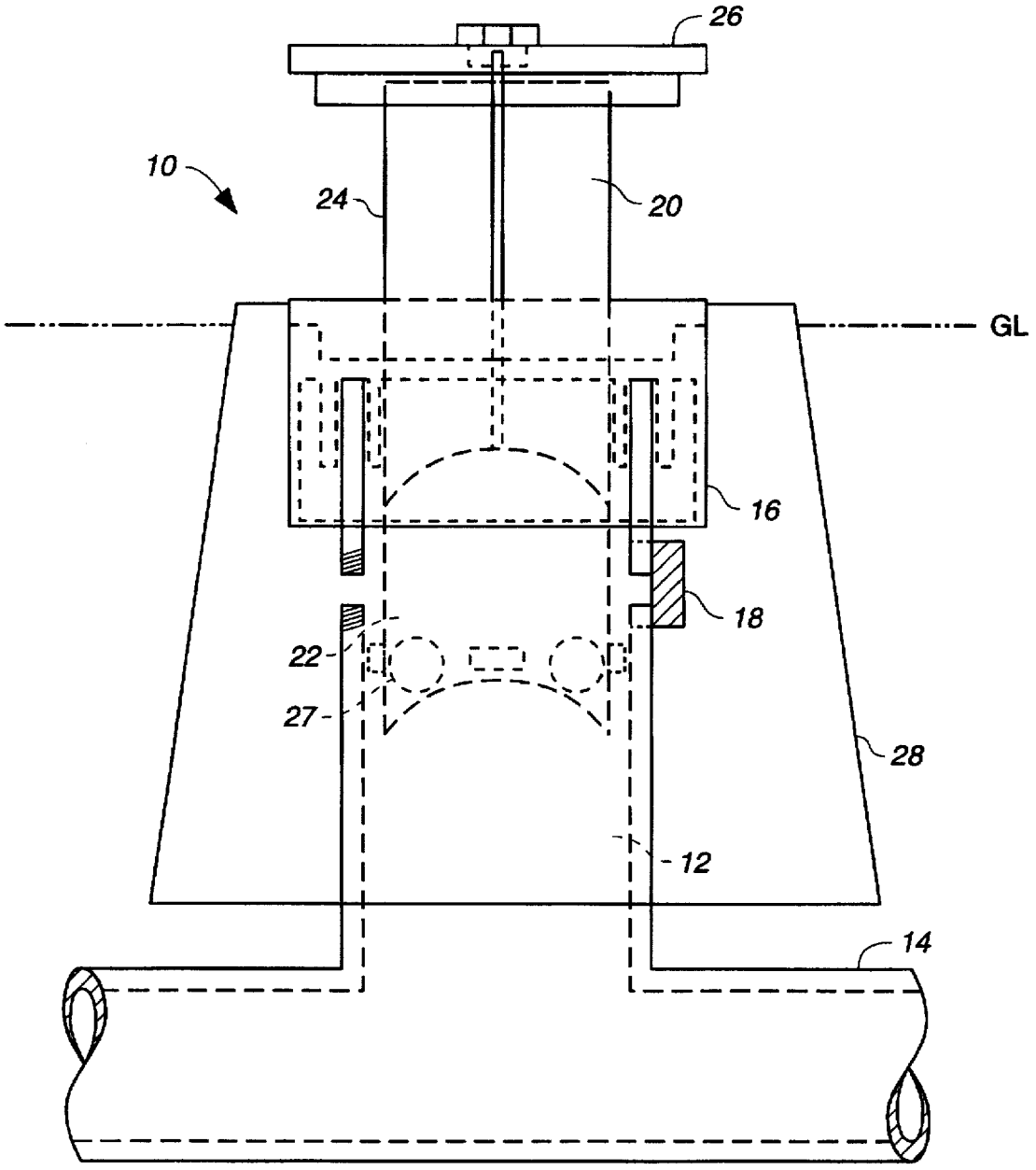
FIG. 1 is a side elevation cross-sectional view of a first embodiment of a sewer backup indicator apparatus of this invention, as installed on the cleanout riser of a typical sewer lateral, illustrating the component parts of the apparatus including a cylinder or housing portion adapted for attachment to the cleanout riser by a coupler, and a vertically movable piston portion slidably engaged within the housing portion, the piston portion including a float member, a wall member, and a cap member, and further illustrating a box portion for burial around the apparatus adjacent to ground level.

FIG. 1 is a side elevation cross-sectional view of a first embodiment of a sewer backup indicator apparatus 10 of this invention, as installed on the cleanout riser 12 of a typical sewer lateral 14. This view illustrates the component parts of the apparatus 10 including a cylinder or housing portion 16 adapted for attachment to the cleanout riser 12 by a coupler 18, and a vertically movable piston portion 20 slidably engaged within the housing portion 16. The piston portion 20 includes a float member 22, a wall member 24, and a cap member 26. Float member 22 is preferably brightly colored for easy visibility when extended, as described supra. Cap member 26 is designed to fit upon housing 16 when the apparatus is in the normal, static state (i.e., no sewer backup). The housing portion 16 and/or piston portion 20 may be vented to allow passage of water when the sewer line backs up, as by piston drain port 27.

This view further illustrates a yard box portion 28 for burial around the apparatus 10 to a depth adjacent to ground level GL. Box portion 28 may be filled with gravel or other permeable material to enable drainage in the event of a sewer backup and overflow.

Figure 2:
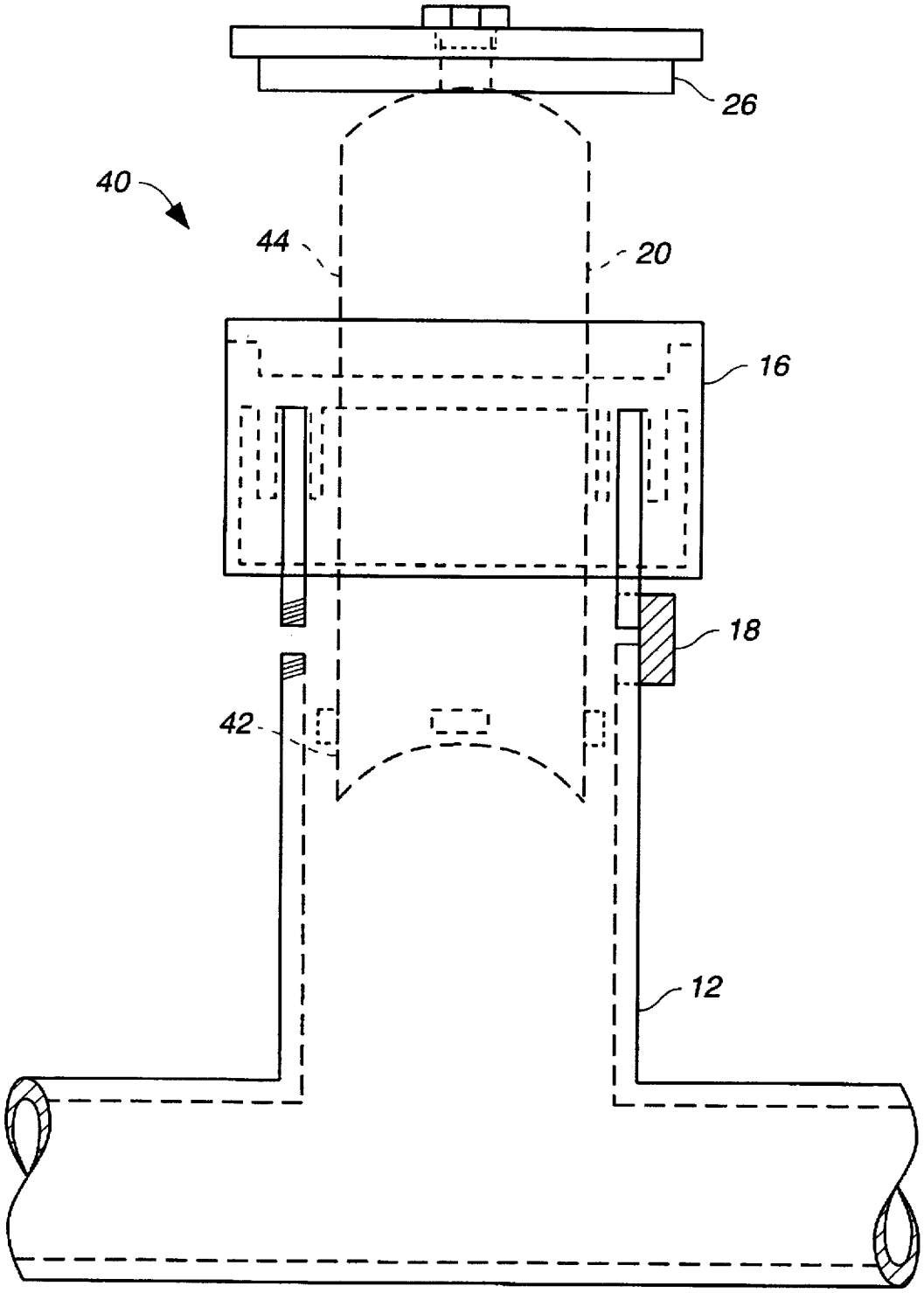
FIG. 2 is a side elevation cross-sectional view of a second embodiment of a sewer backup indicator apparatus of this invention, wherein the piston portion float member is integral and contiguous with the wall member.

FIG. 2 is a side elevation cross-sectional view of a second embodiment 40 of a sewer backup indicator apparatus of this invention. Here, the piston portion float member 42 is integral and contiguous with the wall member 44.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A sewer backup indicator apparatus providing visual indication of an impending sewer backup, for installation on the cleanout riser of a sewer lateral, said apparatus comprising:

a housing portion adapted for attachment to the cleanout riser; and a vertically movable piston portion slidably engaged within said housing portion, said piston portion including a float member, a wall member, and a cap member, wherein when sewage is not backed up into the cleanout riser, said piston portion wall member is contained within said housing portion, and when sewage backs up into the cleanout riser, said float member urges said piston portion to move vertically within said housing portion to reveal said wall member.

2. The sewer backup indicator apparatus of claim 1 wherein said piston portion float member and wall member are contiguous.

3. The sewer backup indicator apparatus of claim 1 further including a box portion placed over said housing portion and piston portion, said box portion adapted for burial up to ground level.

4. The sewer backup indicator apparatus of claim 1 wherein said housing portion is attached to the cleanout riser by a coupler.

5. The sewer backup indicator apparatus of claim 1 wherein said piston portion wall member is brightly colored for greater visibility.

* * * * *